US008449957B2

(12) United States Patent
Nito et al.

(10) Patent No.: US 8,449,957 B2
(45) Date of Patent: May 28, 2013

(54) RECORDING MEDIUM

(75) Inventors: Yasuhiro Nito, Yokohama (JP); Hisao Kamo, Ushiku (JP); Tetsuro Noguchi, Hachioji (JP); Ryo Taguri, Sagamihara (JP); Isamu Oguri, Yokohama (JP); Olivia Herlambang, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/231,803

(22) Filed: Sep. 13, 2011

(65) Prior Publication Data

US 2012/0070591 A1 Mar. 22, 2012

(30) Foreign Application Priority Data

Sep. 21, 2010 (JP) ..... 2010-210901

(51) Int. Cl.
*B41M 5/40* (2006.01)

(52) U.S. Cl.
USPC ..... 428/32.34; 428/328; 428/704

(58) Field of Classification Search
CPC ..... B41M 5/5218; B41M 5/52; B41M 5/5245; C08K 3/22
USPC ..... 428/32.34, 328, 704
See application file for complete search history.

(56) References Cited

U.S. PATENT DOCUMENTS

| | | | | |
|---|---|---|---|---|
| 5,372,884 | A * | 12/1994 | Abe et al. | 428/32.36 |
| 2009/0011155 | A1 * | 1/2009 | Kamo et al. | 428/32.25 |

FOREIGN PATENT DOCUMENTS

| | | | |
|---|---|---|---|
| JP | 5-16015 | B | 3/1993 |
| JP | 7-232473 | A | 9/1995 |
| JP | 8-132731 | A | 5/1996 |
| JP | 9-66664 | A | 3/1997 |
| JP | 9-76628 | A | 3/1997 |
| JP | 2001-260519 | A | 9/2001 |
| JP | 3791039 | B2 | 6/2006 |

* cited by examiner

*Primary Examiner* — Betelhem Shewareged
(74) *Attorney, Agent, or Firm* — Canon U.S.A., Inc., IP Division

(57) ABSTRACT

A recording medium includes an ink-receiving layer on a substrate, in which the ink-receiving layer contains a hydrated alumina, an alkylsulfonic acid having 1 to 4 carbon atoms, and at least one salt of a sulfur compound represented by general formula (1) or (2):

$R_1—SO_2M_1$ general formula (1)

$R_2—SO_2—SM_2$ general formula (2)

wherein $R_1$ and $R_2$ each represent an alkyl group, an aryl group, or a heterocyclic group; and $M_1$ and $M_2$ each represent an alkali metal, ammonium, or an alkanolamine. The proportion of the alkylsulfonic acid having 1 to 4 carbon atoms is in the range of 1.0% by mass to 2.0% by mass with respect to the hydrated alumina. The proportion of the salt of the sulfur compound is in the range of 0.2% by mass to 4.0% by mass with respect to the hydrated alumina.

5 Claims, No Drawings

RECORDING MEDIUM

BACKGROUND OF THE INVENTION

1. Field of the Invention

The present invention relates to a recording medium.

2. Description of the Related Art

Recording media including ink-receiving layers on substrates are known as recording media on which recording is performed by ink jet recording methods or with felt-tip pens. Ink-receiving layers contain inorganic pigments, such as silica and hydrated alumina, and binders, such as polyvinyl alcohols. Such recording media are required to have improved ink absorbency, moisture resistance, ozone resistance, and so forth. In the case where dispersions are used as coating liquids for forming ink-receiving layers and where ink-receiving layers are formed by applying coating liquids on substrates, inorganic pigments are required to be satisfactorily dispersed in dispersions.

Japanese Patent No. 3791039 discloses an alumina sol containing hydrated alumina and a deflocculant. As the deflocculant, a sulfonic acid that does not have a carbon atom, e.g., sulfamic acid, an alkylsulfonic acid having 5 or more carbon atoms, e.g., hexanesulfonic acid, a sulfonic acid having a benzene ring, or the like is used. Japanese Patent No. 3791039 also discloses that an alumina dispersion has a solid content of 15% to 30% by weight and an ink-receiving layer to be formed has satisfactory absorbency.

Japanese Patent Laid-Open No. 2001-260519 discloses a recording medium having satisfactory ink absorbency, preservability, and gloss, the recording medium including an ink-receiving layer that contains silica and one compound selected from sulfinic acid compounds, thiosulfonic acid compounds, and thiosulfinic acid compounds.

SUMMARY OF THE INVENTION

According to one aspect of the present invention, a recording medium includes an ink-receiving layer on a substrate, in which the ink-receiving layer contains a hydrated alumina, an alkylsulfonic acid having 1 to 4 carbon atoms, and at least one salt of a sulfur compound represented by general formula (1) or (2):

$$R_1—SO_2M_1 \quad \text{general formula (1)}$$

$$R_2—SO_2—SM_2 \quad \text{general formula (2)}$$

wherein $R_1$ and $R_2$ each represent an alkyl group, an aryl group, or a heterocyclic group; and $M_1$ and $M_2$ each represent an alkali metal, ammonium, or an alkanolamine. The proportion of the alkylsulfonic acid having 1 to 4 carbon atoms is in the range of 1.0% by mass to 2.0% by mass with respect to the hydrated alumina. The proportion of the salt of the sulfur compound is in the range of 0.2% by mass to 4.0% by mass with respect to the hydrated alumina.

Further features of the present invention will become apparent from the following description of exemplary embodiments.

DESCRIPTION OF THE EMBODIMENTS

Embodiments of a recording medium according to aspects of the present invention will be described below in detail. The recording medium according to aspects of the present invention includes an ink-receiving layer on at least one surface of a substrate.

Studies by the inventors demonstrated that when sulfamic acid, an alkylsulfonic acid having 5 or more carbon atoms, e.g., hexanesulfonic acid, a sulfonic acid having a benzene ring, or the like was used as a deflocculant as described in Japanese Patent No. 3791039, the moisture resistance was not good under severe environmental conditions. Furthermore, a higher deflocculant content resulted in a reduction in ink absorbency. A lower deflocculant content resulted in a reduction in ozone resistance. It was difficult to achieve a balance between ink absorbency and ozone resistance at a high level by merely controlling the amount of the deflocculant.

In Japanese Patent Laid-Open No. 2001-260519, the ink-receiving layer has a very high sulfide carboxylic acid content. In an example (for example, a recording sheet 7), the ink-receiving layer contains 10% by mass or more compound A-1 (sulfide carboxylic acid). So, when the technique was used for a hydrated alumina dispersion containing hydrated alumina serving as an inorganic pigment, the dispersion gelled in some cases. Moreover, the ink-receiving layer had insufficient ink absorbency.

Aspects of the present invention provide a recording medium having satisfactory ink absorbency, moisture resistance, and ozone resistance.

Substrate

Examples of the substrate include paper, such as cast coated paper, baryta paper, and resin coated paper (resin coated paper in which both surfaces of a base is coated with a resin, such as polyolefin); and films. Among these substrates, resin-coated paper can be used from the viewpoint of achieving good gloss after the formation of the ink-receiving layer. As the films, transparent films made of thermoplastic resins, such as polyethylene, polypropylene, polyester, polylactic acid, polystyrene, polyacetate, polyvinyl chloride, cellulose acetate, polyethylene terephthalate, polymethyl methacrylate, and polycarbonate, can be used. Unsized paper or coated paper, which is appropriately sized paper, or a sheet-like material (e.g., synthetic paper) made of an opaque film obtained by filling an inorganic material or by fine foaming may also be used. Furthermore, for example, a sheet made of glass or a metal may be used. To improve the adhesive strength between the substrate and the ink-receiving layer, a surface of the substrate may be subjected to corona discharge treatment or any undercoating treatment.

Ink-Receiving Layer

Hydrated Alumina

The ink-receiving layer included in the recording medium according to aspects of the present invention contains hydrated alumina serving as a pigment. A compound represented by general formula (X) can be used as the hydrated alumina:

$$Al_2O_{3-n}(OH)_{2n}.mH_2O \quad \text{(X)}$$

wherein n represents 0, 1, 2, or 3; m represents a value in the range of 0 to 10, such as 0 to 5, provided that both m and n are not zero at the same time; $mH_2O$ often represents eliminable water that is not involved in the formation of a crystal lattice, so that m may represent an integer or a noninteger; and when the material is heated, m may reach zero.

Crystal structures of hydrated alumina are known to be amorphous, gibbsite, and boehmite, depending on the temperature of heat treatment. Hydrated alumina having any of these crystal structures may be used. Hydrated alumina having a boehmite structure or amorphous structure, which is determined by X-ray diffraction analysis, can be used. Specific examples of hydrated alumina include hydrated alumina described in Japanese Patent Laid-Open Nos. 7-232473, 8-132731, 9-66664, and 9-76628. Hydrated alumina such that when the ink-receiving layer is formed, the entire ink-receiving layer may have an average pore radius of 7.0 nm to 10.0 nm and even 8.0 nm or more may be used. An average pore radius of the entire ink-receiving layer of 7.0 nm to 10.0 nm results in excellent ink absorbency and color developability. An average pore radius of the entire ink-receiving layer of less than 7.0 nm can result in the lack of ink absorbency even if the amount of a binder with respect to hydrated alumina is adjusted. An average pore radius of the entire ink-receiving layer of more than 10.0 nm can result in an increase in the haze of the ink-receiving layer, thereby failing to provide satisfactory color developability. Furthermore, a pore having a radius of 25.0 nm or more in the ink-receiving layer may not be present. The presence of the pore having a radius of 25.0 nm can result in an increase in the haze of the ink-receiving layer, thereby failing to provide satisfactory color developability.

The entire ink-receiving layer can have a total pore volume of 0.50 mL/g or more. A total pore volume of less than 0.50 mL/g can result in the lack of ink absorbency of the entire ink-receiving layer even if the amount of a binder with respect to hydrated alumina is adjusted. Furthermore, the entire ink-receiving layer can have a total pore volume of 30.0 mL/g or less.

The average pore radius, the total pore volume, and the pore radius are values determined from a nitrogen adsorption-desorption isotherm by the Barrett-Joyner-Halenda (BJH) method, the nitrogen adsorption-desorption isotherm being obtained by measurement using the nitrogen adsorption-desorption method. In particular, the average pore radius is a value determined by calculation from the total pore volume and a specific surface area measured by nitrogen desorption. In the case where measurement is performed on the recording medium by the nitrogen adsorption-desorption method, the measurement is performed also on a portion other than the ink-receiving layer. However, components other than the ink-receiving layer (for example, the substrate and the resin-coated layer) do not have pores having a size falling within a range that can be usually measured by the nitrogen absorption-desorption method, i.e., the components do not have pores each having a size of 1 nm to 100 nm. So, in the case where measurement is performed on the entire recording medium by the nitrogen absorption-desorption method, the measurement is regarded as measurement to determine the average pore radius of the ink-receiving layer.

To form the ink-receiving layer having an average pore radius of 7.0 nm to 10.0 nm, hydrated alumina may have a BET specific surface area of 100 $m^2/g$ to 200 $m^2/g$ and even 125 $m^2/g$ to 175 $m^2/g$. A BET method is a method for measuring the surface area of a powder using a gas-phase adsorption technique and is a method for determining the total surface area of 1 g of a sample, i.e., a specific surface area, from an adsorption isotherm. In the BET method, nitrogen gas is commonly used as a gas to be adsorbed. A method in which the amount of the gas adsorbed is measured on the basis of a change in the pressure or volume of the gas adsorbed is most often employed. The most famous equation that indicates a multimolecular adsorption isotherm is the Brunauer-Emmett-Teller equation, which is referred to as the BET equation widely used in specific surface area determination. In the BET method, the amount of adsorbate is determined on the basis of the BET equation and is then multiplied by the area occupied by one adsorbate molecule on a surface to determine the specific surface area. In the BET method, in the case of the measurement of the nitrogen adsorption-desorption method, the amounts of adsorbate at several relative pressures are measured to calculate the gradient and intercept of the plot by the method of least squares, thereby determining the specific surface area. According to aspects of the present invention, the amounts of adsorbate adsorbed are measured at five different relative pressures to determine the specific surface area.

Particles of the hydrated alumina can have a plate-like shape, an average aspect ratio of 3.0 to 10, and a length-to-width ratio of a surface of each plate-like particle of 0.60 to 1.0. The aspect ratio may be determined by a method described in Japanese Patent Publication No. 5-16015. The aspect ratio is defined by the ratio of the diameter to the thickness of each particle. The term "diameter" used here indicates the diameter (circle-equivalent diameter) of a circle having an area equal to the projected area of each hydrated alumina particle when the hydrated alumina is observed with a microscope or an electron microscope. The length-to-width ratio of the surface of each plate-like particle indicates the ratio of the minimum diameter to the maximum diameter of the surface of the plate-like particle when the particle is observed with a microscope in the same way as the aspect ratio. The use of hydrated alumina particles each having an aspect ratio outside the above range can cause the ink-receiving layer to have a narrow pore size distribution. It can be thus difficult to produce hydrated alumina particles having a uniform particle size. Similarly, the use of hydrated alumina particles each having a length-to-width ratio outside the above range causes the ink-receiving layer to have a narrow pore size distribution.

Findings by the inventors reveal that plate-like hydrated alumina particles have higher dispersibility than fibrous hydrated alumina even though they are the same hydrated alumina. In the case where the fibrous hydrated alumina particles are applied onto a surface of a substrate, the fibrous hydrated alumina particles can be arranged in parallel to the surface. This can form small pores to reduce the ink absorbency of the ink-receiving layer. In contrast, the plate-like hydrated alumina can satisfactorily form pores of the ink-receiving layer.

The ink-receiving layer can have a hydrated alumina content of 30.0% by mass to 98.0% by mass.

Binder

The ink-receiving layer included in the recording medium according to aspects of the present invention can contain a binder. A material which is capable of bonding hydrated alumina particles to form a film and which does not significantly impair the advantages of the present invention can be used as the binder. Examples of the binder include starch derivatives, such as oxidized starch, etherified starch, and phosphorylated starch; cellulose derivatives, such as carboxymethyl cellulose and hydroxyethyl cellulose; casein, gelatin, soybean protein, polyvinyl alcohol, and derivatives thereof; conjugated polymer latexes, such as polyvinylpyrrolidone, maleic anhydride resins, styrene-butadiene copolymers, and methyl methacrylate-butadiene copolymers; acrylic polymer latexes, such as polymers of acrylic esters and methacrylic esters; vinyl polymer latexes, such as ethylene-vinyl acetate copolymers; functional-group-modified polymer latexes prepared by modifying the foregoing polymers with monomers each having a functional group, such as a carboxylic group; cationized polymers prepared by the cationization of the foregoing polymers with cationic groups; cationized polymers having cationized surfaces prepared by cationizing surfaces of the foregoing polymers with cationic surfactants; polymers having polyvinyl alcohol moieties distributed over their surfaces, the polymers being prepared by polymerizing the foregoing polymers in the presence of cationic polyvinyl alcohol; polymers having cationic colloidal particles distributed over their surfaces, the polymers being prepared by polymerizing the foregoing polymers in suspensions of cationic colloidal particles; aqueous binders, such as thermosetting synthetic resins, e.g., melamine resins and urea resins; polymer and copolymer resins, such as polymethyl methacrylate; and synthetic resin binders, such as polyurethane resins, unsaturated polyester resins, vinyl chloride-vinyl acetate copolymers, polyvinyl butyral, and alkyd resins. These materials may be used separately or in combination as a mixture. Among these materials, polyvinyl alcohol can be used as the binder. A common polyvinyl alcohol, which is produced by hydrolysis of polyvinyl acetate, can be used as the binder. The polyvinyl alcohol may have a viscosity-average polymerization degree of 1500 or more such as 2000 or more, and 5000 or less. The polyvinyl alcohol may have a saponification degree of 80 or more such as 85 or more, and 100 or less.

The ink-receiving layer may have a polyvinyl alcohol content of 7.0% by mass to 12.0% by mass and even 8.0% by mass to 9.0% by mass with respect to hydrated alumina. A polyvinyl alcohol content of less than 7.0% by mass can result in the ink-receiving layer having low strength. A polyvinyl alcohol content exceeding 12.0% by mass can result in the promotion of the gelation of the coating liquid, thereby reducing coating suitability.

Deflocculant

The ink-receiving layer is formed by applying the ink receiving layer coating liquid on the substrate. The ink receiving layer coating liquid contains a hydrated alumina dispersion. Hydrated alumina particles can be satisfactorily dispersed in the hydrated alumina dispersion. So, the hydrated alumina dispersion according to aspects of the present invention contains an alkylsulfonic acid having 1 to 4 carbon atoms as a deflocculant. As a result, the ink-receiving layer contains the alkylsulfonic acid having 1 to 4 carbon atoms. Thus, the hydrated alumina particles can be stably dispersed in the hydrated alumina dispersion.

The use of an alkylsulfonic acid having 5 or more carbon atoms or a sulfonic acid having a benzene ring as the deflocculant is liable to cause reductions in color stability, moisture resistance, and image density. The reason for this is presumably as follows: An increase in the number of carbon atoms increases the hydrophobicity of the deflocculant, thereby increasing the hydrophobicity of surfaces of the hydrated alumina particles. Hence, a dye fixation rate is reduced on the surfaces of the hydrated alumina particles. In the case where the deflocculation of hydrated alumina particles is performed with the alkylsulfonic acid having 5 or more carbon atoms or a sulfonic acid having a benzene ring, it is difficult to provide sufficient dispersion stability. The viscosity is thus likely to increase. Furthermore, the hydrated alumina particles can be aggregated to reduce the image density.

The alkylsulfonic acid having 1 to 4 carbon atoms according to aspects of the present invention can be a monobasic acid having only a sulfonic acid group serving as a solubilizing group. The use of an alkyl group that does not have a solubilizing group, e.g., a hydroxy group or carboxy group, can result in good moisture resistance. The alkylsulfonic acid can be a monobasic acid and can have an unsubstituted alkyl group having 1 to 4 carbon atoms. Furthermore, the alkyl group may be linear or branched. Examples of the alkylsulfonic acid that can be used include methanesulfonic acid, ethanesulfonic acid, isopropanesulfonic acid, n-propanesulfonic acid, n-butanesulfonic acid, i-butanesulfonic acid, and tert-butanesulfonic acid. Among these compounds, methanesulfonic acid, ethanesulfonic acid, isopropanesulfonic acid, and n-propanesulfonic acid can be used. In particular, methanesulfonic acid can be used. These alkylsulfonic acids each having 1 to 4 carbon atoms may be used in combination of two or more.

In the ink-receiving layer of the recording medium according to aspects of the present invention, the proportion of the alkylsulfonic acid having 1 to 4 carbon atoms is set in the range of 1.0% by weight to 2.0% by weight with respect to hydrated alumina. A proportion of less than 1.0% by weight results in unsatisfactory moisture resistance and ozone resistance. A proportion exceeding 2.0% by weight results in unsatisfactory ink absorbency. The proportion can be set in the range of 1.3% by weight to 1.6% by weight.

Salt of Sulfur Compound

The ink-receiving layer of the recording medium according to aspects of the present invention contains at least one salt of a sulfur compound represented by general formula (1) or (2):

$$R_1—SO_2M_1 \qquad \text{general formula (1)}$$

$$R_2—SO_2—SM_2 \qquad \text{general formula (2)}$$

wherein $R_1$ and $R_2$ each represent an alkyl group, an aryl group, or a heterocyclic group; and $M_1$ and $M_2$ each represent an alkali metal, ammonium, or an alkanolamine.

Even if a hydrated alumina dispersion having a solid content of more than 30.0% by mass, which is a very high content, the presence of the at least one compound represented by general formula (1) or (2) provides a stable dispersion. This makes it possible to apply hydrated alumina in high concentration, thereby significantly increasing the productivity of the ink-receiving layer by application. Furthermore, the presence of the at least one compound provides satisfactory ink absorbency and ozone resistance. In such a compound, a sulfur atom is oxidized by an acid gas, such as ozone. This will inhibit the oxidation of a coloring material by ozone. In aspects of the present invention, even if the compound represented by general formula (1) or (2) is dissociated in the ink-receiving layer, we shall consider that the ink-receiving layer contains the compound represented by general formula (1) or (2). The salt of the sulfur compound according to aspects of the present invention indicates the compound represented by general formula (1) or (2).

$R_1$ and $R_2$ each represent an alkyl group, an aryl group, or a heterocyclic group. Each of the alkyl, aryl, and heterocyclic groups may have a substituent. Examples of the substituent include amino, amide, hydroxy, and methyl groups. Each of $R_1$ and $R_2$ can be an alkyl group having 1 to 10 carbon atoms.

Specific examples of the compound represented by general formula (1) include sodium methanesulfinate, sodium p-toluenesulfinate, sodium 4-acetamidobenzenesulfinate, sodium 4-vinylbenzenesulfininate, sodium formamidinesulfinate, sodium 4-chlorobenzenesulfinate, sodium benzenesulfinate, sodium hydroxymethanesulfinate, and trifluoromethanesulfinate. Among these compounds, sodium p-toluenesulfinate can be used from the viewpoint of achieving good ozone resistance.

Specific examples of the compound represented by general formula (2) include potassium p-toluenethiosulfonate, S-sodium ethanethiosulfonate, 2,2'-thiobis(sodium ethanesulfonate), and 2,2'-dithiobis(sodium ethanesulfonate). Among these compounds, S-sodium ethanesulfonate can be used from the viewpoint of achieving good ozone resistance.

In the case where the compound represented by general formula (1) or (2) is neutralized with an alkanolamine, for example, ethanolamine, diethanolamine, or triethanolamine, the compound can be used from the viewpoint of achieving good ozone resistance. The neutralized salt is prepared by mixing the compound represented by general formula (1) or (2) with an alkaline compound in a ratio of, for example, 1:1 for neutralization, in which the number of moles of the alkaline compound is equal to the number of moles of an acid functional group (sulfonic acid) per molecule of the compound represented by general formula (1) or (2).

In the ink-receiving layer of the recording medium according to aspects of the present invention, the proportion of the salt of the sulfur compound is set in the range of 0.2% by mass to 4.0% by mass with respect to hydrated alumina. A proportion of less than 0.2% by mass can result in unsatisfactory ozone resistance. A proportion exceeding 4.0% by mass can cause a reduction in the stability of the hydrated alumina dispersion and a reduction in the moisture resistance of the recording medium. The proportion of the salt of the sulfur compound can be set in the range of 0.5% by mass to 1.5% by mass. A reduction in the stability of the hydrated alumina dispersion can increase the number of coarse particles to reduce the gloss of the recording medium. The gloss of the recording medium at 20° can be 20 or more. In the case where the compound represented by general formula (1) and the compound represented by general formula (2) are used in combination, the total amount of the compounds is defined as the amount of the salt of the sulfur compound. In the case where a plurality of compounds represented by general formula (1) or a plurality of compounds represented by general formula (2) are used in combination, the total amount of the plural compounds is defined as the amount of the salt of the sulfur compound.

The salt of the compound represented by general formula (1) or (2) may have a water solubility of 5.0% by mass or more and even 10.0% by mass or more at room temperature (25° C.). A solubility of less than 5.0% by mass can result in a reduction in the stability of the hydrated alumina dispersion. Furthermore, the solubility can be 50.0% by mass or less. A solubility exceeding 50.0% by mass can be liable to cause moisture absorption in the recording medium. The solubility can be 30.0% by mass or less.

In the ink-receiving layer, upon letting the proportion of the alkylsulfonic acid having 1 to 4 carbon atoms be A percent by mass with respect to hydrated alumina, and upon letting the proportion of the salt of the sulfur compound be B percent by mass with respect to hydrated alumina, B/A can be in the range of 0.31 to 1.15. When B/A is in the range of 0.31 to 1.15, both the compounds act synergistically to improve the ozone resistance.

The compound represented by general formula (1) or (2) in the ink-receiving layer may be contained in the hydrated alumina dispersion in advance or may be contained in the ink-receiving layer by applying the ink receiving layer coating liquid and then applying the salt onto the resulting layer. The hydrated alumina dispersion can contain the salt. The presence of the salt in the hydrated alumina dispersion provides the recording medium having satisfactory ink absorbency and moisture resistance. This is because the salt of the compound represented by general formula (1) or (2) is less likely to be localized on the surface of the ink-receiving layer and thus a coloring material is successfully present in the entire dyeing region. Even if the proportion of the hydrated alumina, i.e., the solid content, is high, the hydrated alumina can be satisfactorily dispersed.

Additional Material

In aspects of the present invention, the ink-receiving layer may optionally contain a component that cross-links the binder. Examples of the component that cross-links the binder include boric acid and borate. The presence of boric acid or borate suppresses cracking in the ink-receiving layer. Specific examples of boric acid include orthoboric acid ($H_3BO_3$), metaboric acid, and hypoboric acid. Among these compounds, orthoboric acid can be used from the viewpoint of improving the temporal stability of the coating liquid and suppressing cracking. As the borate, a water-soluble salt of the foregoing boric acid can be used. Specifically, alkaline-earth metal salts of boric acid are exemplified as described below. Examples of the salt include alkali metal salts of boric acid, such as sodium borate (e.g., $Na_2B_4O_7.10H_2O$ and $NaBO_2.4H_2O$) and potassium borate (e.g., $K_2B_4O_7.5H_2O$ and $KBO_2$); ammonium salts of boric acid, such as $NH_4B_4O_9.3H_2O$ and $NH_4BO_2$); and magnesium salts and calcium salts of boric acid. The proportion of boric acid or borate in the ink-receiving layer can be in the range of 5.0% by mass to 50.0% by mass in the form of a solid, with respect to the binder. A proportion exceeding 50.0% by mass can result in a reduction in the temporal stability of the coating liquid. A proportion of less than 5.0% by mass causes difficulty in sufficiently cross-linking the binder.

Examples of additional additives include pH regulators, pigment dispersants, thickeners, flow improvers, antifoaming agents, foam inhibitors, surfactants, release agents, penetrants, color pigments, color dyes, fluorescent whiteners, ultraviolet absorbers, antioxidants, preservatives, fungicides, water resistant additives, dye fixing agents, curing agents, and weatherproofers.

Ink Receiving Layer Coating Liquid

In aspects of the present invention, the ink-receiving layer is formed by applying the ink receiving layer coating liquid onto a substrate. The ink receiving layer coating liquid contains the hydrated alumina dispersion containing hydrated alumina, the alkyl sulfonic acid having 1 to 4 carbon atoms, and water, the binder, and so forth. The hydrated alumina dispersion can contain at least one compound represented by general formula (1) or (2). Furthermore, the ink receiving layer coating liquid may contain an additional material (for example, boric acid).

The proportion of the alkylsulfonic acid in the hydrated alumina dispersion can be in the range of 1.0% by mass to 2.0% by mass with respect to the proportion of the hydrated alumina. The proportion of the salt of the sulfur compound can be in the range of 0.5% by mass to 5.0% by mass with respect to the proportion of the hydrated alumina. So, the hydrated alumina dispersion according to aspects of the present invention has a low viscosity in a stable dispersion state even if the solid content is as high as 30.0% by mass or more. A high solid content of the hydrated alumina dispersion of 30.0% by mass or more results in a high solid content of the ink receiving layer coating liquid containing polyvinyl alcohol and a cross-linking component, thereby increasing the application rate. The solid content of the hydrated alumina dispersion can be in the range of 33.0% by mass to 50.0% by mass.

Examples of a coating method of the ink receiving layer coating liquid that can be employed include various curtain coaters, extrusion coaters, and slide hopper coaters. The coating liquid or a coater head may be heated to adjust the viscosity of the coating liquid at the time of coating. Examples of a hot air dryer that can be used to dry the coating liquid after coating include linear tunnel dryers, arch dryers, air-loop dryers, and sine-curve air float dryers. Furthermore, for example, a dryer using infrared rays, heating dryer, microwaves, or the like may be appropriately used.

EXAMPLES

While the present invention will be described below in more detail by examples and comparative examples, the present invention is not limited thereto.

Production of Substrate

A substrate was produced under conditions described below. First, a paper material having the following composition was prepared using deionized water so as to have a solid content of 3.0% by mass.

Laubholz bleached kraft pulp (LBKP) having a freeness of 450 mL in terms of Canadian Standard Freeness (CSF): 80.00 parts by mass Nadelholz bleached kraft pulp (NBKP) having a freeness of 480 mL in terms of CSF: 20.00 parts by mass cationized starch: 0.60 parts by mass heavy calcium carbonate: 10.00 parts by mass precipitated calcium carbonate: 15.00 parts by mass alkyl ketene dimer: 0.10 parts by mass cationic polyacrylamide: 0.03 parts by mass The resulting paper material was subjected to paper making with a Fourdrinier machine, in which three-stage wet pressing was performed, followed by drying with a multi-cylinder dryer. The resulting paper was impregnated with an aqueous solution of oxidized starch so as to have a solid content of 1.0 g/m$^2$ with a size press, and then dried. The dry paper was subjected to calendering to provide a base paper having a basis weight of 170 g/m$^2$, a Stockigt sizing degree of 100 seconds, an air permeability of 50 seconds, a Bekk smoothness of 30 seconds, and a Gurley stiffness of 11.0 mN.

A resin composition containing low-density polyethylene (70 parts by mass), high-density polyethylene (20 parts by mass), and titanium oxide (10 parts by mass) was applied onto a surface of the resulting base paper in an amount of 25.0 g/m$^2$. Then, a resin composition containing high-density polyethylene (50 parts by mass) and low-density polyethylene (50 parts by mass) was applied onto a rear surface and the surface onto which the resin composition had been applied in an amount of 25.0 g/m$^2$ per surface, thereby providing a resin-coated substrate.

Preparation of Hydrated Alumina Dispersion

Hydrated Alumina Dispersion 1

First, 100 g of hydrated alumina (Disperal HP14, manufactured by Sasol), 1.0% by mass of methanesulfonic acid with respect to the hydrated alumina, and 1.0% by mass of sodium p-toluenesulfinate (compound represented by general formula (1)) were mixed in 195 g of deionized water. The mixture was stirred with a mixer for 30 minutes to prepare a hydrated alumina dispersion 1. After 30 minutes, a satisfactory dispersion state of hydrated alumina was visually observed. The solid content of the hydrated alumina dispersion was measured and found to be 33.0% by mass. The solid content was measured by weighing 5.0 g of the hydrated alumina dispersion and performing measurement at 120° C. with an infrared moisture meter (Model: FD-620, manufactured by Kett Electric Laboratory).

Hydrated Alumina Dispersion 2

A hydrated alumina dispersion 2 having the same composition as the hydrated alumina dispersion 1 was prepared under the same conditions as those of the hydrated alumina dispersion 1, except that the methanesulfonic acid content was set to 1.3% by mass with respect to the hydrated alumina content. After 30 minutes, a satisfactory dispersion state of hydrated alumina was visually observed. The solid content of the hydrated alumina dispersion was similarly measured and found to be 33.0% by mass.

Hydrated Alumina Dispersion 3

A hydrated alumina dispersion 3 having the same composition as the hydrated alumina dispersion 1 was prepared under the same conditions as those of the hydrated alumina dispersion 1, except that the methanesulfonic acid content was set to 1.6% by mass with respect to the hydrated alumina content. After 30 minutes, a satisfactory dispersion state of hydrated alumina was visually observed. The solid content of the hydrated alumina dispersion was similarly measured and found to be 33.0% by mass.

Hydrated Alumina Dispersion 4

A hydrated alumina dispersion 4 having the same composition as the hydrated alumina dispersion 1 was prepared under the same conditions as those of the hydrated alumina dispersion 1, except that the methanesulfonic acid content was set to 2.0% by mass with respect to the hydrated alumina content. After 30 minutes, a satisfactory dispersion state of hydrated alumina was visually observed. The solid content of the hydrated alumina dispersion was similarly measured and found to be 33.0% by mass.

Hydrated Alumina Dispersion 5

A hydrated alumina dispersion 5 having the same composition as the hydrated alumina dispersion 1 was prepared under the same conditions as those of the hydrated alumina dispersion 1, except that the methanesulfonic acid content was set to 1.6% by mass with respect to the hydrated alumina content and that the sodium p-toluenesulfinate content was set to 0.5% by mass with respect to the hydrated alumina content. After 30 minutes, a satisfactory dispersion state of hydrated alumina was visually observed. The solid content of the hydrated alumina dispersion was similarly measured and found to be 33.0% by mass.

Hydrated Alumina Dispersion 6

A hydrated alumina dispersion 6 having the same composition as the hydrated alumina dispersion 1 was prepared under the same conditions as those of the hydrated alumina dispersion 1, except that the methanesulfonic acid content was set to 1.3% by mass with respect to the hydrated alumina content and that the sodium p-toluenesulfinate content was set to 1.5% by mass with respect to the hydrated alumina content. After 30 minutes, a satisfactory dispersion state of hydrated alumina was visually observed. The solid content of the hydrated alumina dispersion was similarly measured and found to be 33.0% by mass.

Hydrated Alumina Dispersion 7

A hydrated alumina dispersion 7 having the same composition as the hydrated alumina dispersion 1 was prepared under the same conditions as those of the hydrated alumina dispersion 1, except that the methanesulfonic acid content was set to 1.0% by mass with respect to the hydrated alumina content and that the sodium p-toluenesulfinate content was set to 4.0% by mass with respect to the hydrated alumina content. After 30 minutes, a satisfactory dispersion state of hydrated alumina was visually observed. The solid content of the hydrated alumina dispersion was similarly measured and found to be 33.0% by mass.

Hydrated Alumina Dispersion 8

A hydrated alumina dispersion 8 having the same composition as the hydrated alumina dispersion 1 was prepared under the same conditions as those of the hydrated alumina dispersion 1, except that the methanesulfonic acid content was set to 2.0% by mass with respect to the hydrated alumina content and that the sodium p-toluenesulfinate content was set to 0.2% by mass with respect to the hydrated alumina content. After 30 minutes, a satisfactory dispersion state of hydrated alumina was visually observed. The solid content of the hydrated alumina dispersion was similarly measured and found to be 33.0% by mass.

Hydrated Alumina Dispersion 9

A hydrated alumina dispersion 9 having the same composition as the hydrated alumina dispersion 3 was prepared under the same conditions as those of the hydrated alumina dispersion 3, except that triethanolamine p-toluenesulfinate was used in place of sodium p-toluenesulfinate. After 30 minutes, a satisfactory dispersion state of hydrated alumina was visually observed. The solid content of the hydrated alumina dispersion was similarly measured and found to be 33.0% by mass.

Hydrated Alumina Dispersion 10

A hydrated alumina dispersion 10 having the same composition as the hydrated alumina dispersion 3 was prepared under the same conditions as those of the hydrated alumina dispersion 3, except that S-sodium ethanethiosulfonate was used in place of sodium p-toluenesulfinate. After 30 minutes, a satisfactory dispersion state of hydrated alumina was visually observed. The solid content of the hydrated alumina dispersion was similarly measured and found to be 33.0% by mass.

Hydrated Alumina Dispersion 11

A hydrated alumina dispersion 11 having the same composition as the hydrated alumina dispersion 3 was prepared under the same conditions as those of the hydrated alumina dispersion 3, except that S-triethanolamine ethanesulfonate was used in place of sodium p-toluenesulfinate. After 30 minutes, a satisfactory dispersion state of hydrated alumina was visually observed. The solid content of the hydrated alumina dispersion was similarly measured and found to be 33.0% by mass.

Hydrated Alumina Dispersion 12

A hydrated alumina dispersion 12 having the same composition as the hydrated alumina dispersion 3 was prepared under the same conditions as those of the hydrated alumina dispersion 3, except that ethanesulfonic acid was used in place of methanesulfonic acid. After 30 minutes, a satisfactory dispersion state of hydrated alumina was visually observed. The solid content of the hydrated alumina dispersion was similarly measured and found to be 33.0% by mass.

Hydrated Alumina Dispersion 13

A hydrated alumina dispersion 13 having the same composition as the hydrated alumina dispersion 3 was prepared under the same conditions as those of the hydrated alumina dispersion 3, except that butanesulfonic acid was used in place of methanesulfonic acid. After 30 minutes, a satisfactory dispersion state of hydrated alumina was visually observed. The solid content of the hydrated alumina dispersion was similarly measured and found to be 33.0% by mass.

Hydrated Alumina Dispersion 14

A hydrated alumina dispersion 14 having the same composition as the hydrated alumina dispersion 1 was prepared under the same conditions as those of the hydrated alumina dispersion 1, except that the methanesulfonic acid content was set to 0.8% by mass. After 30 minutes, a satisfactory dispersion state of hydrated alumina was visually observed. The solid content of the hydrated alumina dispersion was similarly measured and found to be 33.0% by mass.

Hydrated Alumina Dispersion 15

A hydrated alumina dispersion 15 having the same composition as the hydrated alumina dispersion 2 was prepared under the same conditions as those of the hydrated alumina dispersion 2, except that the sodium p-toluenesulfinate content was set to 0.1% by mass. After 30 minutes, a satisfactory dispersion state of hydrated alumina was visually observed. The solid content of the hydrated alumina dispersion was similarly measured and found to be 33.0% by mass.

Hydrated Alumina Dispersion 16

A hydrated alumina dispersion 16 having the same composition as the hydrated alumina dispersion 1 was prepared under the same conditions as those of the hydrated alumina dispersion 1, except that the sodium p-toluenesulfinate content was set to 5.0% by mass. It was visually observed that a satisfactory dispersion state was not obtained 30 minutes after the start of stirring and that the mixture was in the form of a gel. The solid content of the hydrated alumina dispersion was similarly measured and found to be 33.0% by mass.

Hydrated Alumina Dispersion 17

A hydrated alumina dispersion 17 having the same composition as the hydrated alumina dispersion 1 was prepared under the same conditions as those of the hydrated alumina dispersion 1, except that ammonium chloride was used in place of sodium p-toluenesulfinate. After 30 minutes, a satisfactory dispersion state of hydrated alumina was visually observed. The solid content of the hydrated alumina dispersion was similarly measured and found to be 33.0% by mass.

Hydrated Alumina Dispersion 18

A hydrated alumina dispersion 18 having the same composition as the hydrated alumina dispersion 1 was prepared under the same conditions as those of the hydrated alumina dispersion 1, except that the methanesulfonic acid content was set to 2.5% by mass and that sodium p-toluenesulfinate was not added. After 30 minutes, a satisfactory dispersion state of hydrated alumina was visually observed. The solid content of the hydrated alumina dispersion was similarly measured and found to be 33.0% by mass.

Hydrated Alumina Dispersion 19

A hydrated alumina dispersion 19 having the same composition as the hydrated alumina dispersion 1 was prepared under the same conditions as those of the hydrated alumina dispersion 1, except that the methanesulfonic acid content was set to 1.6% by mass and that sodium p-toluenesulfinate was not added. It was visually observed that a satisfactory dispersion state was not obtained 30 minutes after the start of stirring and that the mixture was in the form of a gel. The solid content of the hydrated alumina dispersion was similarly measured and found to be 33.0% by mass.

Hydrated Alumina Dispersion 20

First, 100 g of hydrated alumina (Disperal HP14, manufactured by Sasol) and 1.3% by mass of methanesulfonic acid with respect to the hydrated alumina content were mixed in 250 g of deionized water. The mixture was stirred with a mixer for 30 minutes to prepare a hydrated alumina dispersion 20. After 30 minutes, a satisfactory dispersion state of hydrated alumina was visually observed. The solid content of the hydrated alumina dispersion was measured and found to be 28.0% by mass.

Hydrated Alumina Dispersion 21

A hydrated alumina dispersion 21 having the same composition as the hydrated alumina dispersion 3 was prepared under the same conditions as those of the hydrated alumina dispersion 3, except that sulfamic acid was used as methanesulfonic acid. It was visually observed that a satisfactory dispersion state was not obtained 30 minutes after the start of stirring and that the mixture was in the form of a gel. The solid content of the hydrated alumina dispersion was similarly measured and found to be 33.0% by mass.

Hydrated Alumina Dispersion 22

A hydrated alumina dispersion 22 having the same composition as the hydrated alumina dispersion 3 was prepared under the same conditions as those of the hydrated alumina dispersion 3, except that benzenesulfonic acid was used in place of methanesulfonic acid. It was visually observed that a satisfactory dispersion state was not obtained 30 minutes after the start of stirring and that the mixture was in the form of a gel. The solid content of the hydrated alumina dispersion was similarly measured and found to be 33.0% by mass.

Example 1

A polyvinyl alcohol (PVA 235, manufactured by Kuraray Co., Ltd., degree of polymerization: 3500, saponification degree: 88%) was dissolved in ion exchanged water to form an aqueous polyvinyl alcohol solution having a solid content of 9.0% by mass. The resulting aqueous polyvinyl alcohol solution was mixed with the hydrated alumina dispersion 1 in such a manner that the solid content of the polyvinyl alcohol was set to 9.0% by mass with respect to the solid content of the hydrated alumina. An aqueous boric acid solution having a solid content of 3.0% by mass was added thereto in such a manner that the solid content of the boric acid was set to 1.5% by mass with respect to the solid content of the hydrated alumina, thereby providing a ink receiving layer coating liquid.

The resulting ink receiving layer coating liquid was applied onto the foregoing substrate with a slide die in a coating weight of 35.0 g/m$^2$. The temperature of the coating liquid was set to 45° C. After the coating, drying was performed at 80° C. to provide a recording medium of Example 1.

Examples 2 to 13 and Comparative Examples 1 to 9

Recording media of EXAMPLES 2 to 13 and COMPARATIVE EXAMPLES 1 to 9 were produced using hydrated alumina dispersions described in Table 1. The mixing proportions of the polyvinyl alcohol and boric acid with respect to the hydrated alumina were equal to those in Example 1.

Example 14

A polyvinyl alcohol (PVA 235, manufactured by Kuraray Co., Ltd., degree of polymerization: 3500, saponification degree: 88%) was dissolved in ion exchanged water to form an aqueous polyvinyl alcohol solution having a solid content of 9.0% by mass. The resulting aqueous polyvinyl alcohol solution was mixed with the hydrated alumina dispersion 20 in such a manner that the solid content of the polyvinyl alcohol was set to 9.0% by mass with respect to the solid content of the hydrated alumina. An aqueous boric acid solution having a solid content of 3.0% by mass was added thereto in such a manner that the solid content of the boric acid was set to 1.5% by mass with respect to the solid content of the hydrated alumina, thereby providing a ink receiving layer coating liquid.

The resulting ink receiving layer coating liquid was applied onto the foregoing substrate with a slide die in a coating weight of 35.0 g/m$^2$. The temperature of the coating liquid was set to 45° C. Then the resulting article was dried at 80° C. After the completion of the drying, an aqueous solution containing 5.0% by mass sodium p-toluenesulfinate was applied thereon with a bar coater in a wet coating weight of 6.2 g/m$^2$. Drying was performed at 80° C. to produce a recording medium of Example 14. The sodium p-toluenesulfinate content of the ink-receiving layer was 1.0% by mass with respect to the hydrated alumina content.

TABLE 1

| | Hydrated alumina dispersion | | Ink-receiving layer | | | | |
|---|---|---|---|---|---|---|---|
| | | | Deflocculant | | Additive | | |
| | Type | Concentration (% by mass) | Type | Concentration with respect to pigment (% by mass) | Type | Concentration with respect to pigment (% by mass) | Additive/ deflocculant |
| EXAMPLE 1 | 1 | 33.0 | methanesulfonic acid | 1.0 | sodium p-toluenesulfinate | 1.0 | 1.00 |
| EXAMPLE 2 | 2 | 33.0 | methanesulfonic acid | 1.3 | sodium p-toluenesulfinate | 1.0 | 0.77 |
| EXAMPLE 3 | 3 | 33.0 | methanesulfonic acid | 1.6 | sodium p-toluenesulfinate | 1.0 | 0.63 |
| EXAMPLE 4 | 4 | 33.0 | methanesulfonic acid | 2.0 | sodium p-toluenesulfinate | 1.0 | 0.50 |
| EXAMPLE 5 | 5 | 33.0 | methanesulfonic acid | 1.6 | sodium p-toluenesulfinate | 0.5 | 0.31 |
| EXAMPLE 6 | 6 | 33.0 | methanesulfonic acid | 1.3 | sodium p-toluenesulfinate | 1.5 | 1.15 |
| EXAMPLE 7 | 7 | 33.0 | methanesulfonic acid | 1.0 | sodium p-toluenesulfinate | 4.0 | 4.00 |
| EXAMPLE 8 | 8 | 33.0 | methanesulfonic acid | 2.0 | sodium p-toluenesulfinate | 0.2 | 0.10 |
| EXAMPLE 9 | 9 | 33.0 | methanesulfonic acid | 1.6 | triethanolamine p-toluenesulfinate | 1.0 | 0.63 |
| EXAMPLE 10 | 10 | 33.0 | methanesulfonic acid | 1.6 | S-sodium ethanethiosulfonate | 1.0 | 0.63 |
| EXAMPLE 11 | 11 | 33.0 | methanesulfonic acid | 1.6 | S-triethanolamine ethanethiosulfonate | 1.0 | 0.63 |
| EXAMPLE 12 | 12 | 33.0 | ethanesulfonic acid | 1.6 | sodium p-toluenesulfinate | 1.0 | 0.63 |
| EXAMPLE 13 | 13 | 33.0 | butanesulfonic acid | 1.6 | sodium p-toluenesulfinate | 1.0 | 0.63 |
| EXAMPLE 14 | 20 | 28.0 | methanesulfonic acid | 1.3 | p-toluenesulfinic acid (overcoat) | 1.0 | — |
| COMPARATIVE EXAMPLE 1 | 14 | 33.0 | methanesulfonic acid | 0.8 | sodium p-toluenesulfinate | 1.0 | 1.25 |
| COMPARATIVE EXAMPLE 2 | 15 | 33.0 | methanesulfonic acid | 1.3 | sodium p-toluenesulfinate | 0.1 | 0.08 |
| COMPARATIVE EXAMPLE 3 | 16 | 33.0 | methanesulfonic acid | 1.0 | sodium p-toluenesulfinate | 5.0 | 5.00 |
| COMPARATIVE EXAMPLE 4 | 17 | 33.0 | methanesulfonic acid | 1.0 | ammonium chloride | 1.0 | 1.00 |
| COMPARATIVE EXAMPLE 5 | 18 | 33.0 | methanesulfonic acid | 2.5 | not added | — | — |
| COMPARATIVE EXAMPLE 6 | 19 | 33.0 | methanesulfonic acid | 1.6 | not added | — | — |
| COMPARATIVE EXAMPLE 7 | 20 | 28.0 | methanesulfonic acid | 1.3 | not added | — | — |
| COMPARATIVE EXAMPLE 8 | 21 | 33.0 | sulfamic acid | 1.6 | sodium p-toluenesulfinate | 1.0 | 0.63 |
| COMPARATIVE EXAMPLE 9 | 22 | 33.0 | benzenesulfonic acid | 1.6 | sodium p-toluenesulfinate | 1.0 | 0.63 |

Evaluation

The resulting recording media were evaluated as described below. Note that the evaluation of the dispersibility of the hydrated alumina dispersion has been described above.

Evaluation 1: Gloss

The gloss of each of the recording media at 20° was measured with a measuring apparatus (Model: VG 2000, manufactured by Nippon Denshoku Industries Co., Ltd).

Evaluation 2: Ink Absorbency

The ink absorbency of each of the recording media was evaluated. A modified machine of a printer PIXUS Pro9000 (manufactured by CANON KABUSHIKI KAISHA) was used as a recording apparatus, the printing process of the printer being modified. A green solid image with 30 gradation levels (30 gradation levels in 10% duty steps, 0% to 300% duty) was used as a print pattern. Bidirectional printing in which printing was completed by two reciprocal passes at a carriage speed of 25 inch/sec was used. The term "300% duty" in this machine indicates that 67 ng of ink is applied onto a 1/600 inches×1/600 inches square. There is a good positive correlation between the ink absorbency and beading. So, the ink absorbency of the recording medium was evaluated by evaluating beading. Beading is a phenomenon in which when ink has flowability before the ink is completely fixed to a recording medium, a dot formed of the ink moves irregularly on a surface of the recording medium to coalesce with adjacent dot, thereby causing nonuniformity in image density. The evaluation was visually performed according to criteria described below.

Evaluation Criteria

Rank 4: No beading occurs at 300% duty.

Rank 3: Beading occurs at 300% duty, but does not occur at 250% duty.

Rank 2: Beading occurs at 250% duty, but does not occur at 200% duty.

Rank 1: Beading occurs at 150% duty.

Evaluation 3: Moisture Resistance

The moisture resistance of each of the recording media was evaluated. A printer PIXUS Pro9000 (manufactured by CANON KABUSHIKI KAISHA) was used as a recording apparatus. White Chinese characters on a blue background were printed at 48 points and 10 points and were allowed to stand at 30° C. and 90% for 14 days. The degree of bleeding of a coloring material to the white portions before and after being allowed to stand was visually evaluated according to criteria described below.

Evaluation Criteria

Rank 4: For each of the white characters with font sizes of 10 points and 48 points, bleeding does not occur, and the characters are clear.

Rank 3: For each of the white characters with font sizes of 10 points and 48 points, bleeding occurs only slightly, and the characters are not deformed.

Rank 2: For the white characters with font sizes of 10 points, bleeding occurs, and the characters are partially deformed. For the white characters with font sizes of 48 points, bleeding occurs only slightly, and the characters are not deformed.

Rank 1: For each of the white characters with font sizes of 10 points and 48 points, significant bleeding occurs, and the characters are partially deformed.

Evaluation 4: Ozone Resistance

The ozone resistance of each of the recording media was evaluated. A printer PIXUS Pro9000 (manufactured by CANON KABUSHIKI KAISHA) was used as a recording apparatus. A gray patch with 256 gradation levels was printed. A patch portion having an optical density of a value closest to 1.0 in terms of black was exposed to ozone. The ozone resistance was evaluated on the basis of a residual optical density (%) defined by the ratio of the optical density after the ozone exposure to the optical density before the ozone exposure. The ozone exposure was performed for 24 hours at an ambient temperature of 23° C., a humidity of 50%, and an ozone concentration of 10 ppm.

Evaluation Criteria

Rank 4: The residual optical density is 95% or more.

Rank 3: The residual optical density is 90% or more and less than 95%.

Rank 2: The residual optical density is 80% or more and less than 90%.

Rank 1: The residual optical density is less than 80%.

Table 2 shows the evaluation results.

TABLE 2

| | Evaluation results | | | | |
|---|---|---|---|---|---|
| | Dispersibility | Gloss at 20° | Ink absorbency | Moisture resistance | Ozone resistance |
| EXAMPLE 1 | good | 24 | 4 | 3 | 3 |
| EXAMPLE 2 | good | 25 | 4 | 3 | 3 |
| EXAMPLE 3 | good | 23 | 4 | 4 | 3 |
| EXAMPLE 4 | good | 25 | 3 | 4 | 3 |
| EXAMPLE 5 | good | 24 | 3 | 4 | 3 |
| EXAMPLE 6 | good | 24 | 4 | 4 | 3 |
| EXAMPLE 7 | good | 24 | 3 | 3 | 4 |
| EXAMPLE 8 | good | 25 | 4 | 3 | 2 |
| EXAMPLE 9 | good | 25 | 4 | 4 | 4 |
| EXAMPLE 10 | good | 26 | 4 | 4 | 3 |
| EXAMPLE 11 | good | 28 | 4 | 4 | 4 |
| EXAMPLE 12 | good | 25 | 3 | 3 | 3 |
| EXAMPLE 13 | good | 23 | 3 | 2 | 3 |
| EXAMPLE 14 | good | 21 | 2 | 2 | 2 |
| COMPARATIVE EXAMPLE 1 | good | 22 | 4 | 1 | 1 |
| COMPARATIVE EXAMPLE 2 | good | 23 | 4 | 3 | 1 |
| COMPARATIVE EXAMPLE 3 | poor | 11 | 2 | 1 | 4 |
| COMPARATIVE EXAMPLE 4 | good | 24 | 3 | 1 | 1 |
| COMPARATIVE EXAMPLE 5 | good | 22 | 1 | 4 | 2 |
| COMPARATIVE EXAMPLE 6 | poor | 14 | 3 | 3 | 1 |
| COMPARATIVE EXAMPLE 7 | good | 23 | 3 | 2 | 1 |
| COMPARATIVE EXAMPLE 8 | poor | 13 | 3 | 1 | 3 |
| COMPARATIVE EXAMPLE 9 | poor | 12 | 3 | 1 | 3 |

Table 2 shows that in Examples 1 to 14, all of the ink absorbency, moisture resistance, and ozone resistance were satisfactory.

The recording medium of COMPARATIVE EXAMPLE 1 had a low methanesulfonic acid content, thereby leading to unsatisfactory moisture resistance and ozone resistance. The recording medium of COMPARATIVE EXAMPLE 2 had a low proportion of the salt of the sulfur compound, thereby leading to unsatisfactory ozone resistance. The recording medium of COMPARATIVE EXAMPLE 3 had a high proportion of the salt of the sulfur compound, thereby leading to unsatisfactory moisture resistance. Each of the recording media of COMPARATIVE EXAMPLES 4 to 7 did not contain a salt of a sulfur compound, thereby leading to unsatisfactory ink absorbency and ozone resistance. Each of the recording media of COMPARATIVE EXAMPLES 8 and 9 did not contain an alkylsulfonic acid having 1 to 4 carbon atoms, thereby leading to unsatisfactory moisture resistance.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-210901 filed Sep. 21, 2010, which is hereby incorporated by reference herein in its entirety.

What is claimed is:

1. A recording medium comprising:

an ink-receiving layer on a substrate, wherein the ink-receiving layer contains a hydrated alumina, an alkylsulfonic acid having 1 to 4 carbon atoms, and at least one salt of a sulfur compound represented by general formula (1) or (2):

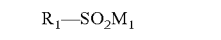

$R_1—SO_2M_1$ general formula (1)

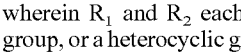

$R_2—SO_2-SM_2$ general formula (2)

wherein $R_1$ and $R_2$ each represent an alkyl group, an aryl group, or a heterocyclic group; and $M_1$ and $M_2$ each represent an alkali metal, ammonium, or an alkanolamine, wherein the proportion of the alkylsulfonic acid having 1 to 4 carbon atoms is in the range of 1.0% by mass to 2.0% by mass with respect to the hydrated alumina, and the proportion of the salt of the sulfur compound is in the range of 0.2% by mass to 4.0% by mass with respect to the hydrated alumina.

2. The recording medium according to claim 1, wherein upon letting the proportion of the alkylsulfonic acid having 1 to 4 carbon atoms be A percent by mass with respect to hydrated alumina, and upon letting the proportion of the salt of the sulfur compound be B percent by mass with respect to hydrated alumina, B/A is in the range of 0.31 to 1.15.

3. The recording medium according to claim 1, wherein the alkylsulfonic acid having 1 to 4 carbon atoms is methanesulfonic acid.

4. The recording medium according to claim 1, wherein the $M_1$ and $M_2$ each represent an alkanolamine.

5. A method for producing the recording medium according to claim 1, the method comprising:

applying an ink receiving layer coating liquid onto the substrate to form the ink-receiving layer, the coating liquid containing a hydrated alumina dispersion and a binder, wherein the hydrated alumina dispersion has a solid content of more than 30.0% by mass.

* * * * *